US012398009B2

(12) United States Patent
Yoshigai

(10) Patent No.: US 12,398,009 B2
(45) Date of Patent: Aug. 26, 2025

(54) PRINTING APPARATUS AND PRINTING METHOD

(71) Applicant: Shigeru Yoshigai, Kanagawa (JP)

(72) Inventor: Shigeru Yoshigai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 176 days.

(21) Appl. No.: 18/206,085

(22) Filed: Jun. 6, 2023

(65) Prior Publication Data

US 2023/0399187 A1 Dec. 14, 2023

(30) Foreign Application Priority Data

Jun. 9, 2022 (JP) ..... 2022-093895

(51) Int. Cl.
*B65H 7/20* (2006.01)

(52) U.S. Cl.
CPC ..... *B65H 7/20* (2013.01); *B65H 2511/52* (2013.01); *B65H 2551/15* (2013.01); *B65H 2551/21* (2013.01); *B65H 2801/15* (2013.01)

(58) Field of Classification Search
CPC ..... B65H 7/20
See application file for complete search history.

(56) References Cited

U.S. PATENT DOCUMENTS

| | | | | |
|---|---|---|---|---|
| 2001/0010769 | A1 | 8/2001 | Ishii et al. | |
| 2007/0047993 | A1* | 3/2007 | Brinsley | G03G 15/5004 399/75 |
| 2018/0150270 | A1* | 5/2018 | Harayama | G06F 3/1205 |
| 2019/0289161 | A1 | 9/2019 | Yoshigai | |
| 2022/0274396 | A1 | 9/2022 | Yoshigai | |
| 2023/0044459 | A1 | 2/2023 | Yoshigai | |
| 2023/0166522 | A1* | 6/2023 | Murayama | B41J 29/393 347/7 |

FOREIGN PATENT DOCUMENTS

| | | |
|---|---|---|
| JP | 2001-199591 | 7/2001 |
| JP | 2007-001186 | 1/2007 |
| JP | 2017-154296 | 9/2017 |

* cited by examiner

*Primary Examiner* — Sharon Polk
(74) *Attorney, Agent, or Firm* — XSENSUS LLP

(57) ABSTRACT

A printing apparatus includes: a holder configured to hold a medium; a conveyor configured to convey the holder; a printing device configured to print on the medium conveyed by the conveyor in response to a reception of a print instruction; and circuitry configure to: maintain the printing device in a busy state; receive the print instruction in the busy state; control the conveyor to start conveying the holder to a print start position in response to a reception of the print instruction in the busy state; hold the holder at the print start position in the busy state; and control the printing device to start printing on the medium in response to a release of the printing device from the busy state.

8 Claims, 5 Drawing Sheets

PRINTING APPARATUS AND PRINTING METHOD

CROSS-REFERENCE TO RELATED APPLICATIONS

This patent application is based on and claims priority pursuant to 35 U.S.C. § 119(a) to Japanese Patent Application No. 2022-093895, filed on Jun. 9, 2022, in the Japan Patent Office, the entire disclosure of which is hereby incorporated by reference herein.

BACKGROUND

Technical Field

The present embodiment relates to a printing apparatus and a printing method.

Related Art

For improving productivity in printing, developed has been a technique for performing a preliminary printing operation prior to reception of print data. In order to increase the printing throughput, a maintenance operation and a sheet feeding or ejecting operation of the printing apparatus are performed in parallel.

SUMMARY

A printing apparatus includes: a holder configured to hold a medium; a conveyor configured to convey the holder; a printing device configured to print on the medium conveyed by the conveyor in response to a reception of a print instruction; and circuitry configure to: maintain the printing device in a busy state; receive the print instruction in the busy state; control the conveyor to start conveying the holder to a print start position in response to a reception of the print instruction in the busy state; hold the holder at the print start position in the busy state; and control the printing device to start printing on the medium in response to a release of the printing device from the busy state.

A printing method includes: holding a medium with a holder; conveying the holder; printing on the medium by a printing device in response to a reception of a print instruction; and maintaining the printing device in a busy state; receiving the print instruction in the busy state; conveying the holder to a print start position in response to a reception of the print instruction in the busy state; holding the holder at the print start position in the busy state; and controlling the printing device to start printing on the medium in response to a release of the printing device from the busy state.

BRIEF DESCRIPTIONS OF DRAWINGS

A more complete appreciation of embodiments of the present disclosure and many of the attendant advantages and features thereof can be readily obtained and understood from the following detailed description with reference to the accompanying drawings, wherein:

FIG. 1 illustrates an exemplary configuration of an inkjet printer to which a printing apparatus according to a first embodiment is applied;

FIG. 2 explanatorily illustrates an exemplary configuration of a conveyance platen included in the inkjet printer according to the first embodiment;

Figure 1:
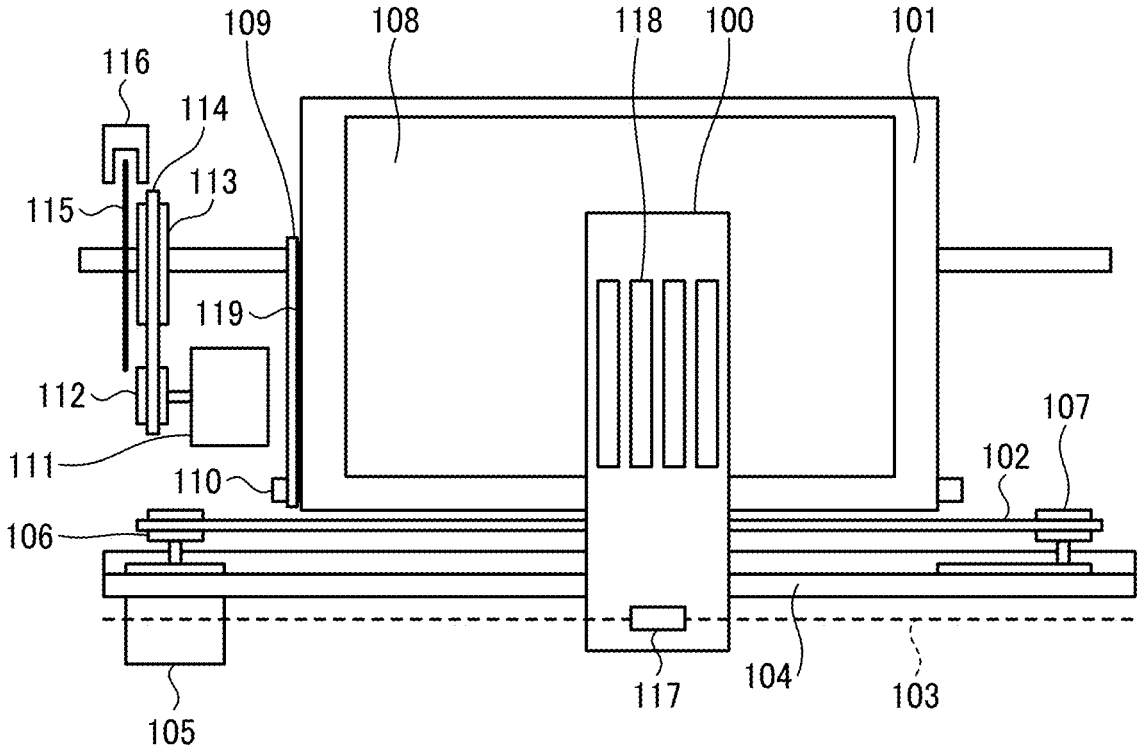

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Hereinafter, embodiments of a printing apparatus will be described in detail with reference to the accompanying drawings.

First Embodiment

FIG. 1 illustrates an exemplary configuration of an inkjet printer to which a printing apparatus according to a first embodiment is applied. The technical scope of the present embodiment is not limited to the scope described in the first embodiment, and thus includes other forms such as a multifunction peripheral and an apparatus that performs printing on a fabric other than a sheet.

The inkjet printer includes a carriage 100, a timing belt 102, a slide rail 104, a main scan motor 105, a driving pulley 106, and a driven pulley 107. The slide rail 104 integrated with a sheet metal holds the carriage 100. The main scan motor 105 causes the carriage 100 to move and scan in the main scan direction through the timing belt 102 stretched across the driving pulley 106 and the driven pulley 107.

The carriage 100 is provided with, for example, a recording head 118 having four droplet discharge heads that discharge ink droplets of colors of yellow (Y), cyan (C), magenta (M), black (K), white 1 (W1), and white 2 (W2). The recording head 118 has a nozzle face provided with a plurality of ink discharge ports (nozzles). The nozzles of the nozzle face are arrayed in a direction (sub scan direction) orthogonal to the main scan direction. The recording head 118 is mounted with the ink discharge ports facing downward. Here, one or a plurality of heads having a plurality of nozzle arrays for discharging the droplets (ink droplets) of recording liquids different in color is provided. An independent droplet discharge head, however, can also be provided.

The number of colors and array order of the droplet discharge heads are not limited to the present example.

As an inkjet head serving as the recording head 118, may be provided an inkjet head including, as a pressure generator that generates a pressure for discharging droplets, a piezoelectric actuator such as a piezoelectric element, a thermal actuator using a phase change due to film boiling of a liquid with an electrothermal conversion element such as a heating resistor, a shape memory alloy actuator using a metal phase change due to a temperature change, or an electrostatic actuator using electrostatic force.

The carriage 100 is provided with an encoder scale 103 having a slit along the main scan direction and an encoder sensor 117 that detects the slit of the encoder scale 103. The encoder scale 103 and the encoder sensor 117 serve as a linear encoder for detecting the position of the carriage 100 in the main scan direction.

The inkjet printer further includes a conveyance platen 101, a conveyance roller 109, a tension roller 110, a conveyance driving pulley 112, a conveyance roller pulley 113, a timing belt 114, and a timing belt 119. The conveyance platen 101 serves as a conveyer for conveying a recording medium 108 at a position where the recording medium 108 faces the recording head 118. The sub scan motor 8 rotationally drives the conveyance roller 109 through the timing belt 114 stretched across the conveyance driving pulley 112 and the conveyance roller pulley 113, so that the conveyance platen 101 drives.

The conveyance platen 101 includes an encoder wheel 115 having a slit and the encoder wheel is provided coaxially with the conveyance roller 109. The conveyance platen 101 has a side plate provided with an encoder sensor 116 that detects the slit of the encoder wheel 115. The encoder wheel 115 and the encoder sensor 116 serves as a wheel encoder for detecting the position of the conveyance platen 101 in the sub scan direction. The conveyance platen 101 is of a flatbed type, and is horizontally conveyed in the sub scan direction through the timing belt 119 stretched across the conveyance roller 109 and the tension roller 110.

Figure 2:
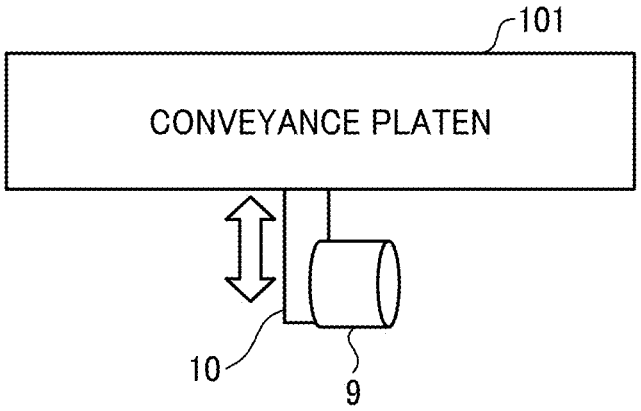

FIG. 2 explanatorily illustrates an exemplary configuration of the conveyance platen 101 included in the inkjet printer according to the first embodiment. In the present embodiment, the conveyance platen 101 serves as a holder that holds a recording medium 108 (exemplary medium), such as a lifting platen. As illustrated in FIG. 2, the inkjet printer further includes a platen lift motor 9 such as a stepping motor (or a direct current (DC) motor), and a gear 10. The platen lift motor 9 causes the conveyance platen 101 to move upward and downward through the gear 10. That is, the platen lift motor 9 and the gear 10 are an exemplary conveyance mechanism that conveys the conveyance platen 101. Specifically, the platen lift motor 9 and the gear 10 are a conveyance mechanism that conveys the conveyance platen 101 from the standby position to the print start position. The "conveyance mechanism" is also referred simply as a "conveyor".

Figure 3:
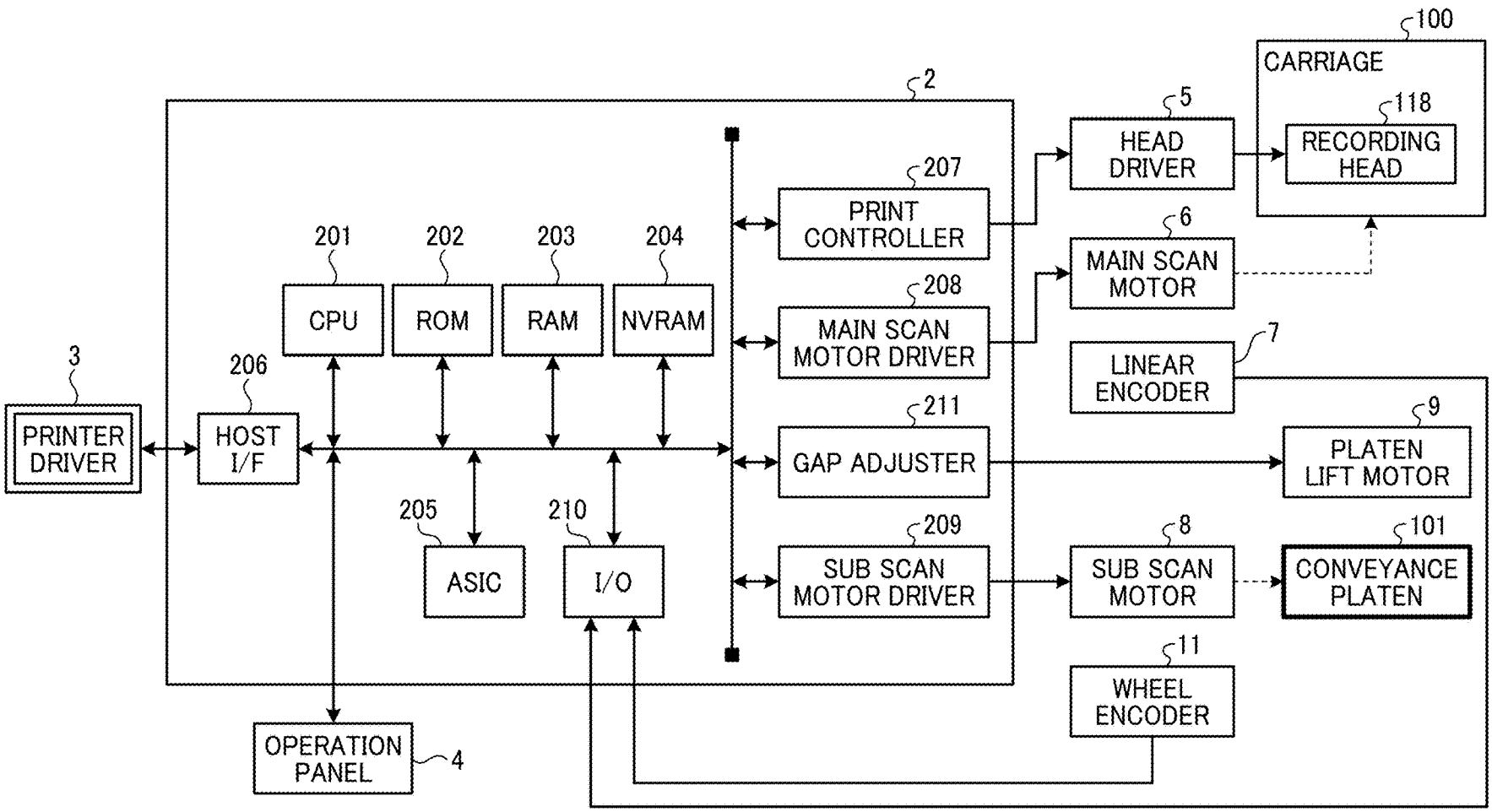
FIG. 3 is an explanatory diagram of an exemplary overview of a controller of the inkjet printer according to the first embodiment.

FIG. 3 is an explanatory diagram of an exemplary overview of a controller of the inkjet printer according to the first embodiment. As illustrated in FIG. 3, the inkjet printer according to the present embodiment includes a controller 2, a printer driver 3, an operation panel 4, a head driver 5, a main scan motor 6, a linear encoder 7, a sub scan motor 8, a wheel encoder 11, the carriage 100, the platen lift motor 9, and the conveyance platen 101.

The controller 2 includes a central processing unit (CPU 201), a read only memory (ROM 202), a random access memory (RAM 203), a non-volatile RAM 204, and an application specific integrated circuit (ASIC 205). The CPU 201 serves as a unit that controls the entirety of the inkjet printer and controls an operation for sheet conveyance and a movement operation of the recording head 118.

The ROM 202 stores programs executed by the CPU 201 and other fixed data. The RAM 203 temporarily stores, for example, image data. The non-volatile RAM 204 is a rewritable memory for holding data even while the power of the inkjet printer is off. The ASIC 205 performs various types of signal processing for image data, image processing of performing rearrangement and others, and processing of input and output signals for controlling the entirety of the inkjet printer.

The controller 2 further includes a host interface (I/F 206), a print controller (head controller 207), a main scan motor driver 208, a sub scan motor driver 209, an input/output (I/O 210), and a gap adjuster 211. The host I/F 206 is an I/F for transmitting and receiving data and various signals to and from the host side. The print controller 207 generates a drive waveform for driving the recording head 118, and outputs image data for selectively driving the pressure generator of the recording head 118 and various pieces of data associated with the image data to the head driver 5.

The main scan motor driver 208 drives the main scan motor 6. The sub scan motor driver 209 drives the sub scan motor 8. The I/O 210 receives, as an input, a detection pulse from the linear encoder 7, a detection pulse from the wheel encoder 11, or detection signals from other various sensors. The operation panel 4 receives and displays information for the inkjet printer. Specifically, the operation panel 4 receives a print instruction from an operator of the inkjet printer, for example.

Here, the controller 2 receives, for example, print data generated by the printer driver 3 of the host, such as an information processing apparatus such as a personal computer, an image reading apparatus such as an image scanner, or an imaging apparatus such as a digital camera at the host I/F 206 through a cable or a network.

Then, the CPU 201 reads and analyzes print data in a reception buffer included in the host I/F 206, to perform image processing and data rearrangement processing in the ASIC 205. The CPU 201 transfers the result to the print controller 207, and outputs image data and a drive waveform from the print controller 207 to the head driver 5 at a required timing. For generation of dot pattern data for image output, for example, font data may be stored in the ROM 202, or the printer driver 3 on the host side may develop image data into bitmap and transfer the developed data to the inkjet printer. Here, such generation is performed with the printer driver 3.

The print controller 207 includes a drive waveform generator including a digital-to-analog (D/A) converter that performs D/A conversion of pattern data of drive pulses stored in the ROM 202 and read by the CPU 201 and an amplifier. The drive waveform generator outputs a drive waveform including a single drive pulse or a plurality of drive pulses to the head driver 5.

The head driver 5 selectively applies a drive pulse included in the drive waveform provided from the drive waveform generator of the print controller 207 to the pressure generator of the recording head 118. As a result, the head driver 5 drives the recording head 118. In the present embodiment, the head driver 5 and the recording head 118 functions as an exemplary printing device that performs printing on the recording medium 108 held by the conveyance platen 101 conveyed to the print start position. The drive waveform generator of the print controller 207 generates such a drive waveform on the basis of serially-input image data (dot pattern data) corresponding to one row of the recording head 118. The head driver 5 includes a shift register, a latch circuit, a level conversion circuit, and an analog switch array, for example. The shift register receives, as inputs, a clock signal and serial data as image data. The latch circuit latches the resist value of the shift register with a latch signal. The level conversion circuit is a level shifter that changes the level of the output value of the latch circuit. The analog switch array is a switch, and the level shifter controls on/off of the analog switch array. Due to the control of on/off of the analog switch array, a drive pulse included in the drive waveform is selectively applied to the pressure generator of the recording head 118.

The platen lift motor 9 drives the conveyance platen 101 upward and downward and a light-emitting diode (LED) sensor detects the conveyance platen 101, so that the gap adjuster 211 adjusts the height of the conveyance platen 101.

Here, an exemplary printing procedure by a comparative example of an inkjet printer is described below. First, when the operator of the inkjet printer presses the height adjustment button of the operation panel 4 and selects the conveyance platen 101 on the operation panel 4, the controller 2 controls the platen lift motor 9 through the gap adjuster 211 to adjust the height of the conveyance platen 101. As a result, the controller 2 causes the conveyance platen 101 to move from the standby position to the print start position.

Next, when image data stored in a main body memory or a universal serial bus (USB) memory is selected on the operation panel 4, the controller 2 outputs the image data to the head driver 5. After the output, when the print start button of the operation panel 4 is pressed, the head driver 5 controls the recording head 118, so that the image data is printed on the recording medium 108.

When the printing on the recording medium 108 is completed, the controller 2 starts maintenance of the recording head 118. During the maintenance of the recording head 118, the operation panel 4 does not allow the USB memory button and the print start button of the operation panel 4 to be operated, and receives no print instruction from the operator. Therefore, the controller 2 cannot output image data to the head driver 5. Even when the operator presses the print start button of the operation panel 4, printing cannot be started, and the operation panel 4 displays a message indicating that the printing cannot be performed due to a busy state.

When the maintenance of the recording head 118 is completed and the busy state is released, the operation panel 4 makes a change to an enabled state where the USB memory button and the print start button can be operated. Then, when the print start button of the operation panel 4 is pressed, the controller 2 transmits image data to the head driver 5, so that printing on a recording medium 108 starts.

Next, an exemplary printing procedure by the inkjet printer according to the present embodiment will be described. First, when the operator of the inkjet printer presses the height adjustment button of the operation panel 4 and selects the conveyance platen 101 on the operation panel 4, the controller 2 controls the platen lift motor 9 through the gap adjuster 111 to adjust the height of the conveyance platen 101. As a result, the controller 2 causes the conveyance platen 101 to move from the standby position to the print start position.

Next, when image data stored in a main body memory or a universal serial bus (USB) memory is selected on the operation panel 4, the controller 2 outputs the image data to the head driver 5. After the output, when the print start button of the operation panel 4 is pressed, the head driver 5 controls the recording head 118, so that the image data is printed on the recording medium 108.

When the printing on the recording medium 108 is completed, the controller 2 starts maintenance of the recording head 118. During the maintenance of the recording head 118, the operation panel 4 allows the USB memory button and the print start button to be operated, and receives a print instruction from the operator. Then, when the print instruction is received by the operation panel 4 during the maintenance (in the busy state) of the recording head 118, the controller 2 outputs image data to the head driver 5. When the maintenance of the recording head 118 is completed, the head driver 5 starts printing on a recording medium 108.

Here, the print instruction is input by pressing of the print start button (an exemplary print instruction button) of the operation panel 4. The print start button is also enabled in the busy state where the recording head 118 is under maintenance. Here, the state where the print start button is enabled means that the print start button can be pressed (operated), that is, a print instruction can be input. In the present embodiment, the print start button (software key) is provided on the operation panel 4, but the present embodiment is not limited to such a software key, and thus the print start button may be provided as a physical button (hardware key).

Specifically, even in a busy state where the recording head 118 is under maintenance, the operation panel 4 receives a print instruction from the operator. In response to the reception of the print instruction, the controller 2 controls the platen lift motor 9 through the gap adjuster 111, so that conveyance of the conveyance platen 101 starts. Then, the conveyance platen 101 is made on standby at the print start position. Then, in response to release of the busy state, the controller 2 controls the head driver 5, so that printing on a recording medium 108 starts. Thus, the print instruction can be executed even the recording head 118 is under maintenance. As a result, the operator does not have to stand by in front of the operation panel 4 until the inkjet printer enters the printable state from the maintenance state where the inkjet printer cannot perform printing.

Figure 4:
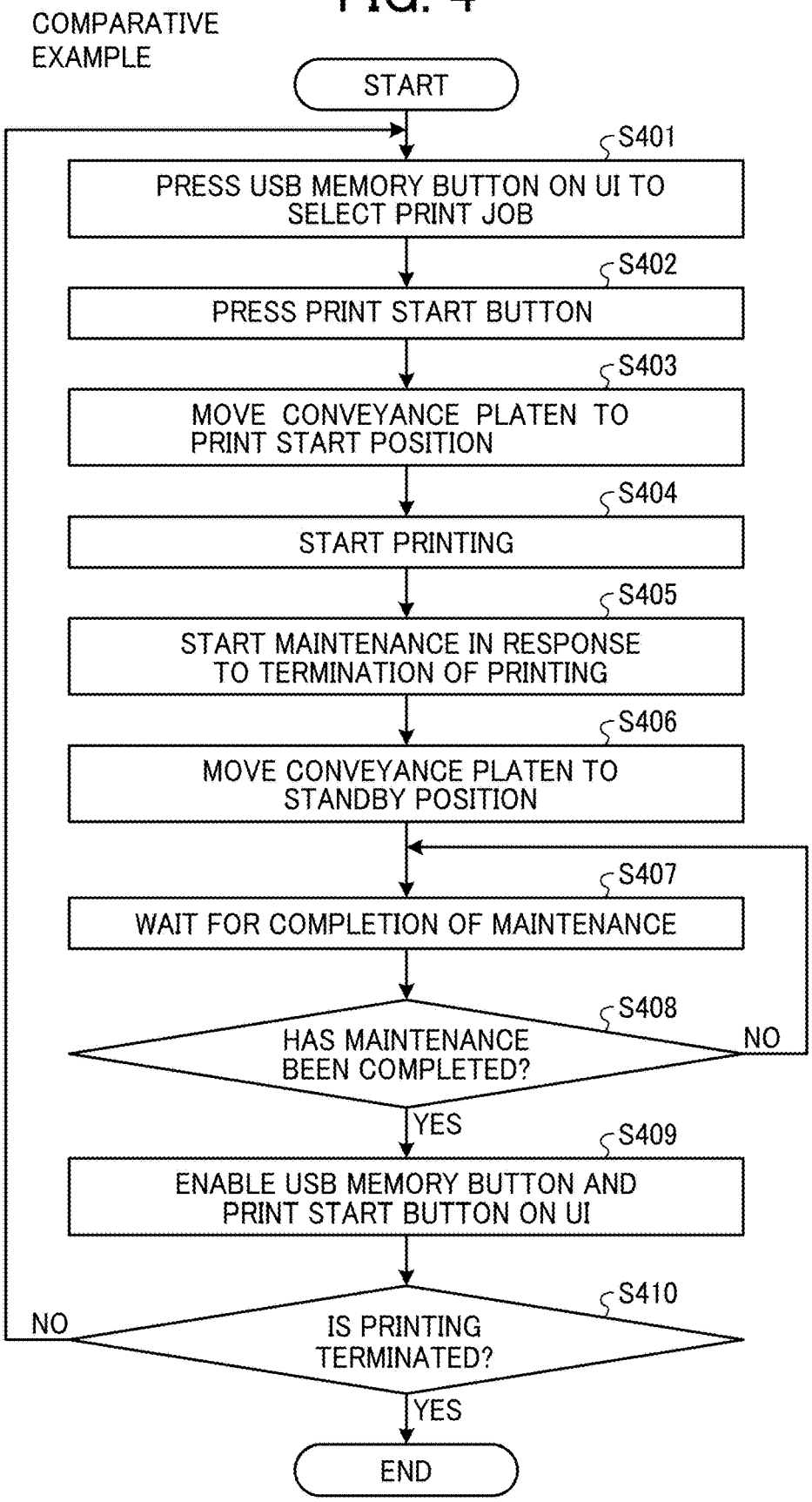
FIG. 4 is a flowchart illustrating an exemplary flow of processing at the time of performing printing by a comparative example of an inkjet printer.

FIG. 4 is a flowchart illustrating an exemplary flow of processing at the time of performing printing by the comparative example of the inkjet printer. First, when the operator of the inkjet printer presses the USB memory button of the operation panel 4 to select a print job (step S401) and further presses the print start button of the operation panel 4 (step S402), the controller 2 causes the conveyance platen 101 to move to the print start position (step S403).

Next, the controller 2 controls the head driver 5, so that printing on a recording medium 108 such as a sheet starts (step S404). In response to termination of the printing on the recording medium 108, the controller 2 starts maintenance of the printing device such as the recording head 118 (step S405). Further, the controller 2 causes the conveyance platen 101 to move from the print start position to the standby position (step S406).

During the maintenance of the printing device, the controller 2 waits for completion of the maintenance (step S407), and determines whether or not the maintenance has been completed (step S408). In a case where the maintenance has not been completed (step S408: No), the controller 2 returns to step S407 and waits for the completion of the maintenance. Otherwise, in a case where the maintenance has been completed (step S408: Yes), the controller 2 makes a change to an enabled state where the USB memory button and the print start button of the operation panel 4 can be operated (step S409). That is, the user interface (UI) (USB memory button and print start button) of the operation panel 4 of the comparative example of the inkjet printer cannot be operated and the print instruction cannot be executed until the maintenance is completed.

Next, the controller 2 determines whether or not to terminate the printing (step S410). In a case where the printing is not to be terminated (step S410: No), the controller 2 returns to step S401. Otherwise, in a case where the printing is to be terminated (step S410; Yes), the controller 2 terminates the printing.

Figure 5:
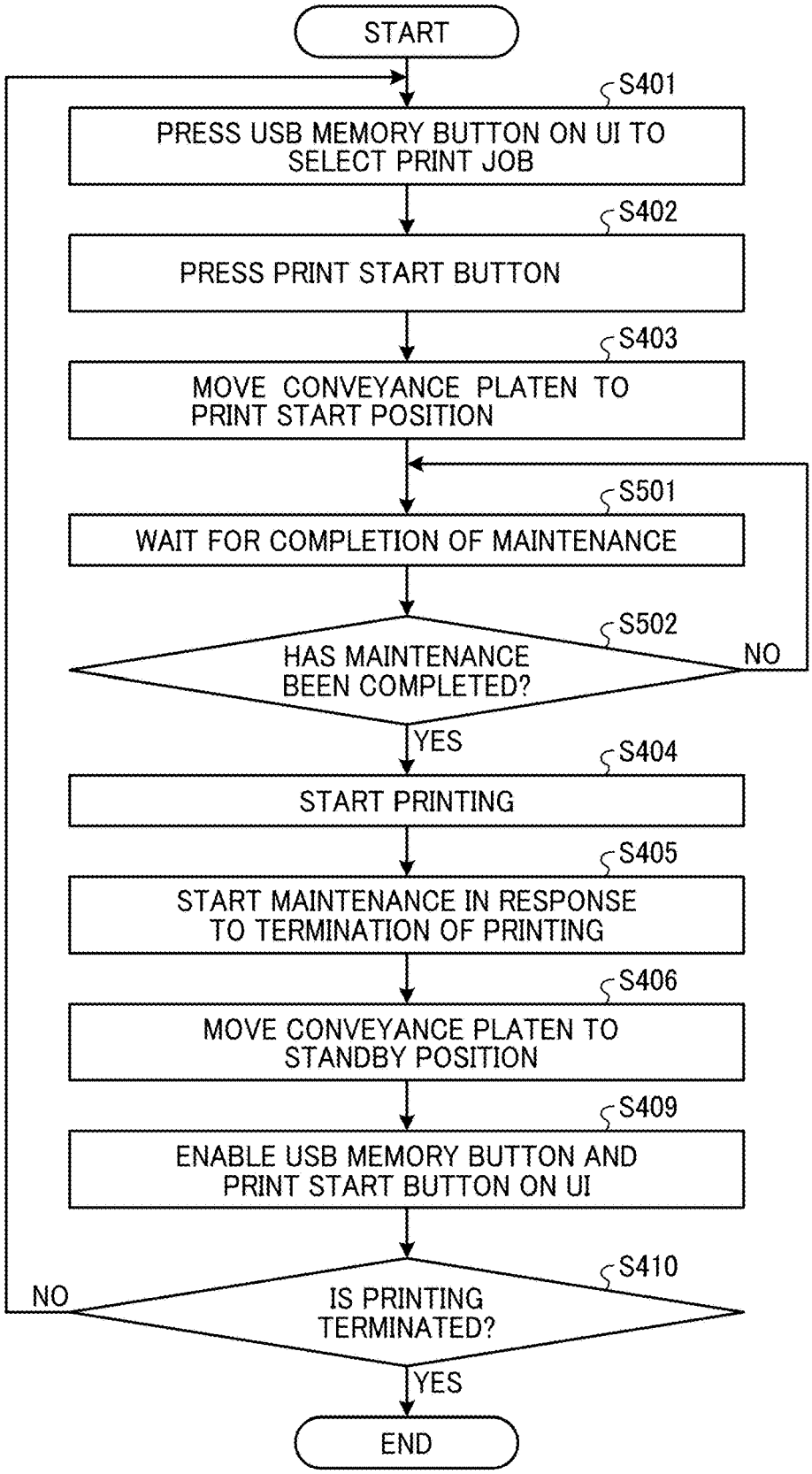
FIG. 5 is a flowchart illustrating an exemplary flow of processing at the time of performing printing by the inkjet printer according to the first embodiment.

FIG. 5 is a flowchart illustrating an exemplary flow of processing at the time of performing printing by the inkjet printer according to the first embodiment. In the following description, description of processing similar to the processing in FIG. 3 is not given.

In the present embodiment, even in a busy state where maintenance of the printing device such as the recording head 118 is under maintenance, the operation panel 4 enables the UI (e.g., the USB memory button and the print start button) of the operation panel 4 to be operated, and receives a print instruction from the operator. In response to the reception of the print instruction from the operator, the conveyance mechanism (the platen lift motor 9 and the gear 10) starts conveyance of the conveyance platen 101. After the start of conveyance, in response to movement of the conveyance platen 101 to the print start position (step S403), the controller 2 makes the conveyance platen 101 on standby at the printing start position (step S501), and determines whether or not to wait for the completion of the maintenance of the printing device (step S502).

In a case where the controller determines to wait for the completion of the maintenance of the printing device (step S502: No), the controller 2 waits for the completion of the maintenance. Otherwise, in a case where the maintenance has been completed (step S502: Yes), that is, in a case where the busy state has been released, the controller 2 proceeds to step S404 and causes the printing device to start printing on a recording medium 108.

As described above, according to the inkjet printer of the first embodiment, the print instruction can be executed even the recording head 118 is under maintenance. As a result, the operator does not have to stand by in front of the operation panel 4 until the inkjet printer enters the printable state from the maintenance state where the inkjet printer cannot perform printing.

Second Embodiment

A second embodiment is an example of determining whether or not an error has occurred in a printing device in a busy state, and terminating printing on a recording medium in a case where an error has occurred in the printing device. In the following description, description of the configurations similar to the configurations of the first embodiment is not given.

In the present embodiment, in the busy state, a head driver 5 determines whether or not an error has occurred in a printing device such as a recording head 118. In a case where an error has occurred in the printing device, the head driver 5 terminates printing on a recording medium 108. As a result, even in a case where a print instruction has been received, printing can be terminated if any error occurs during maintenance.

Further, in the present embodiment, an operation panel 4 also functions as an exemplary display that displays, in a case where an error has occurred in the printing device as the recording head 118, the fact that the error has occurred in the printing device.

Figure 6:
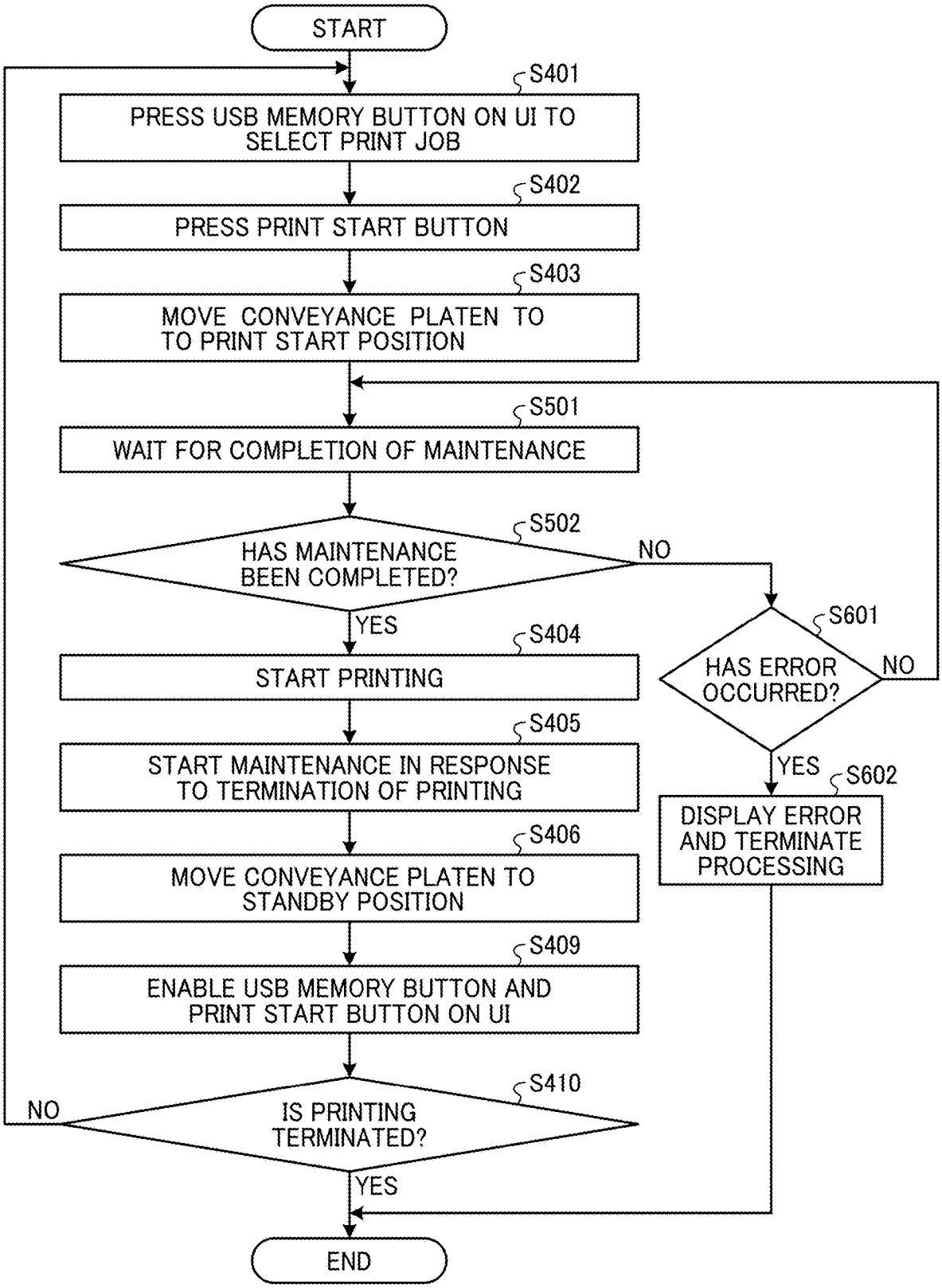
FIG. 6 is a flowchart illustrating an exemplary flow of processing at the time of performing printing by an inkjet printer according to a second embodiment.

FIG. 6 is a flowchart illustrating an exemplary flow of processing at the time of performing printing by an inkjet printer according to the second embodiment. In the following description, description of processing similar to the processing in FIG. 4 is not given.

In the present embodiment, in response to movement of a conveyance platen 101 to the print start position resulting from reception of a print instruction from the operator in a busy state (step S403), the controller 2 determines whether not to wait for completion of the maintenance of the printing device (step S502). In a case where the controller 2 determines to wait for the completion of the maintenance (step S502: No), the controller 2 determines whether or not an error has occurred in the maintenance (step S601).

In a case where the error has occurred in the maintenance (step S601: Yes), the controller 2 causes the operation panel 4 to display the fact that the error has occurred, and terminates the printing processing (step S602). Otherwise, in a case where the printing device is in normal maintenance (step S601: No), the controller 2 returns to step S501 and waits for the completion of the maintenance.

Otherwise, in a case where the maintenance has been completed (step S502: Yes), that is, in a case where the busy state has been released, the controller 2 proceeds to step S404 and causes the printing device to start printing on a recording medium 108.

As described above, according to the inkjet printer of the second embodiment, even in a case where a printing instruction has been received, printing can be terminated if any error occurs during maintenance.

In each embodiment, given has been the example in which the printing apparatus of the present embodiment is applied to a multifunction peripheral having at least two functions of a copy function, a printer function, a scanner function, or a facsimile function. The printing apparatus of the embodiment, however, is applicable to any image forming apparatus such as a copier, a printer, a scanner, and a facsimile.

According to the present embodiment, there is an effect that the operator of the printing apparatus does not have to stand by in front of the operation screen until the printing apparatus enters the printable state from the maintenance state where the printing apparatus cannot perform printing.

[Aspect 1]

A printing apparatus includes: a holder configured to hold a medium: a conveyor configured to convey the holder: a printing device configured to print on the medium conveyed by the conveyor in response to a reception of a print instruction: and circuitry configure to: maintain the printing device in a busy state; receive the print instruction in the busy state; control the conveyor to start conveying the holder to a print start position in response to a reception of the print instruction in the busy state; hold the holder at the print start position in the busy state; and control the printing device to start printing on the medium in response to a release of the printing device from the busy state.

[Aspect 2]

In the printing apparatus according to aspect 1, the circuitry is further configured to: determines whether an error has occurred in the printing device in the busy state; and controls the printing device to terminate printing on the medium in response to an occurrence of the error in the busy state.

[Aspect 3]

The printing apparatus according to aspect 2 further includes a display configured to display the occurrence of the error in response to the occurrence of the error in the busy state.

[Aspect 4]

The printing apparatus according to aspect 1, further includes a print instruction button pressed to input the print instruction to the printing device, and the print instruction button is enabled in the busy state.

[Aspect 5]

A printing method includes: holding a medium with a holder; conveying the holder; printing on the medium by a printing device in response to a reception of a print instruction; and maintaining the printing device in a busy state; receiving the print instruction in the busy state; conveying the holder to a print start position in response to a reception of the print instruction in the busy state: holding the holder at the print start position in the busy state; and controlling the printing device to start printing on the medium in response to a release of the printing device from the busy state.

[Aspect 6]

The printing method according to aspect 5, further includes: determining whether an error has occurred in the printing device in the busy state; and controlling the printing device to terminate printing on the medium in response to an occurrence of the error in the busy state.

[Aspect 7]

The printing method according to aspect 6 further includes displaying the occurrence of the error in response to the occurrence of the error in the busy state.

[Aspect 8]

The printing method according to aspect 5, further includes: inputting the print instruction to the printing device in response to pressing a print instruction button, and enabling the pressing of the print instruction in the busy state.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A printing apparatus comprising:

a holder configured to hold a medium;

a conveyor configured to convey the holder;

a printing device configured to print on the medium conveyed by the conveyor in response to a reception of a print instruction; and circuitry configured to:

maintain the printing device in a busy state;

receive the print instruction in the busy state;

control the conveyor to start conveying the holder to a print start position in response to a reception of the print instruction in the busy state;

hold the holder at the print start position in the busy state; and control the printing device to start printing on the medium in response to a release of the printing device from the busy state.

2. The printing apparatus according to claim 1, wherein the circuitry is further configured to:

determine whether an error has occurred in the printing device in the busy state; and control the printing device to terminate printing on the medium in response to an occurrence of the error in the busy state.

3. The printing apparatus according to claim 2, further comprising a display configured to display the occurrence of the error in response to the occurrence of the error in the busy state.

4. The printing apparatus according to claim 1, further comprising a print instruction button pressed to input the print instruction to the printing device, and the print instruction button is enabled in the busy state.

5. A printing method comprising:

holding a medium with a holder;

conveying the holder;

printing on the medium by a printing device in response to a reception of a print instruction; and maintaining the printing device in a busy state;

receiving the print instruction in the busy state;

conveying the holder to a print start position in response to a reception of the print instruction in the busy state;

holding the holder at the print start position in the busy state; and controlling the printing device to start printing on the medium in response to a release of the printing device from the busy state.

6. The printing method according to claim 5, further comprising:

determining whether an error has occurred in the printing device in the busy state; and controlling the printing device to terminate printing on the medium in response to an occurrence of the error in the busy state.

7. The printing method according to claim 6, further comprising displaying the occurrence of the error in response to the occurrence of the error in the busy state.

8. The printing method according to claim 5, further comprising:

inputting the print instruction to the printing device in response to pressing a print instruction button, and enabling the pressing of the print instruction button in the busy state.

* * * * *